US006860176B1

(12) United States Patent
Hsien

(10) Patent No.: US 6,860,176 B1
(45) Date of Patent: Mar. 1, 2005

(54) BOX END OF WRENCH

(76) Inventor: Chih-Ching Hsien, No. 367, Pei Yang Road, Feng Yuan, Taichung (TW)

( * ) Notice: Subject to any disclaimer, the term of this patent is extended or adjusted under 35 U.S.C. 154(b) by 0 days.

(21) Appl. No.: 10/718,632

(22) Filed: Nov. 24, 2003

(51) Int. Cl.[7] ..... B25B 13/06
(52) U.S. Cl. ..... 81/124.1; 81/121.1; 81/124.3
(58) Field of Search ..... 81/119, 121.1, 81/124.1, 124.3, 124.4, 124.7

(56) References Cited

U.S. PATENT DOCUMENTS 1,936,352 A * 11/1933 Dixon ..... 81/124.4
2,488,894 A * 11/1949 Barrett ..... 81/124.1
4,459,716 A * 7/1984 Valadez ..... 81/121.1
5,640,889 A * 6/1997 Anderson ..... 81/124.1
6,634,261 B1 * 10/2003 Griffin ..... 81/124.1

* cited by examiner

*Primary Examiner*—Debra S. Meislin

(57) ABSTRACT

A wrench includes a box end which has a through hole and a polygonal inner periphery is defined in an inner periphery of the through hole and located close to a first side of the box end. A plain inner surface is defined in the inner periphery of the through hole and located close to a second side of the box end. An inner diameter of the plain inner periphery is larger than an inner diameter of the polygonal inner periphery. A spring member is engaged with the through hole of the box end and enclosed by the polygonal inner periphery. A nut can be engaged with the polygonal inner periphery by pressing the spring member and is rotated with the wrench, or is freely rotatably engaged with the plain inner surface while the spring member is not compressed.

7 Claims, 9 Drawing Sheets

BOX END OF WRENCH

FIELD OF THE INVENTION

The present invention relates to wrench having a box end which includes a plain inner surface and allows the box end to be rotated regardless of the nut in the box end.

BACKGROUND OF THE INVENTION

A conventional wrench having a box end is used for a long time and the box end has a polygonal inner periphery so that an object such as a nut or a screw head can be engaged with the polygonal inner periphery and rotated with the wrench. An inherent shortcoming of the conventional box end wrench is that the box end has to be removed from the nut after being rotated an angle and re-cap to the nut at desired position. This shortcoming is more obvious when other objects are located close to the nut and the user is suffered by the repeated actions of removing the box end from the nut and re-mounting the box end to the nut.

The present invention intends to provide a wrench, especially to a box end of a wrench wherein a plain surface is defined in an end of the inner periphery of the box end and a spring member is engaged with the box end so that the wrench can be freely rotated regardless of the object when the object is located in the position enclosed by the plain surface.

SUMMARY OF THE INVENTION

The present invention relates to a wrench that comprises a handle and a box end is connected to the handle. The box end has a through hole and a polygonal inner periphery is defined in an inner periphery of the through hole and located close to a first side of the box end. A plain inner surface is defined in the inner periphery of the through hole and located close to the second side of the box end. An inner diameter of the plain inner periphery is larger than an inner diameter of the polygonal inner periphery. A spring member is engaged with the through hole of the box end and enclosed by the polygonal inner periphery.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
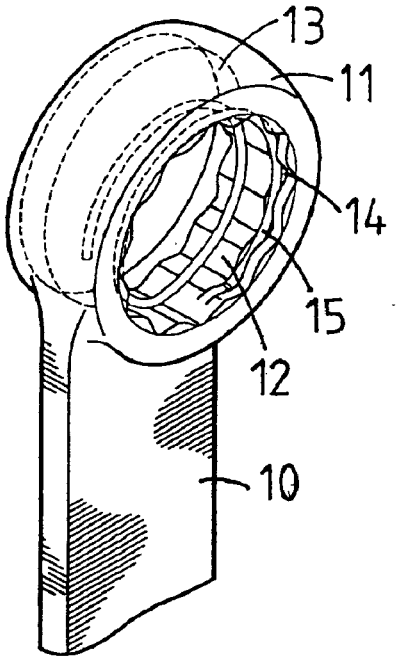
FIG. 1 is a perspective view to show the box end of the wrench of the present invention.
Figure 2:
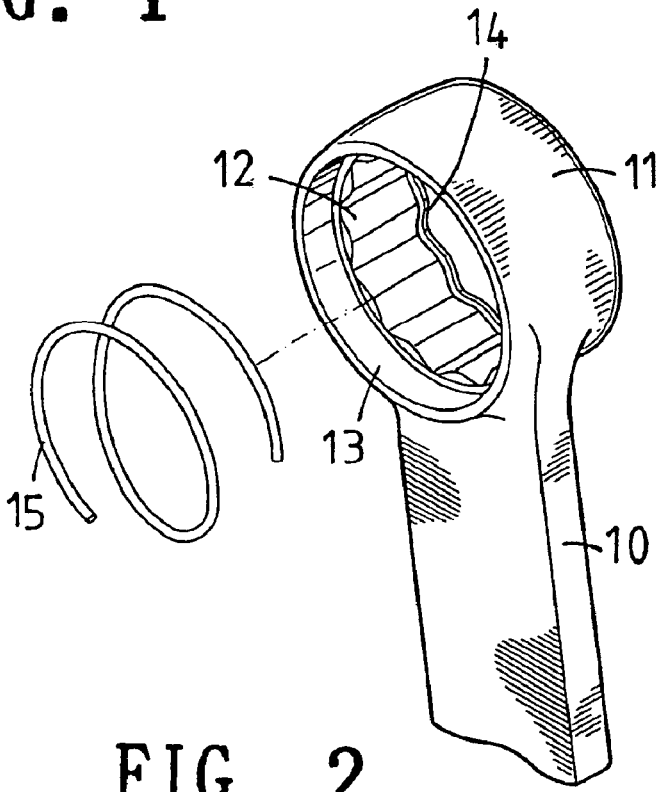
FIG. 2 is an exploded view to show a spring member and the wrench of the present invention.
Figure 3:
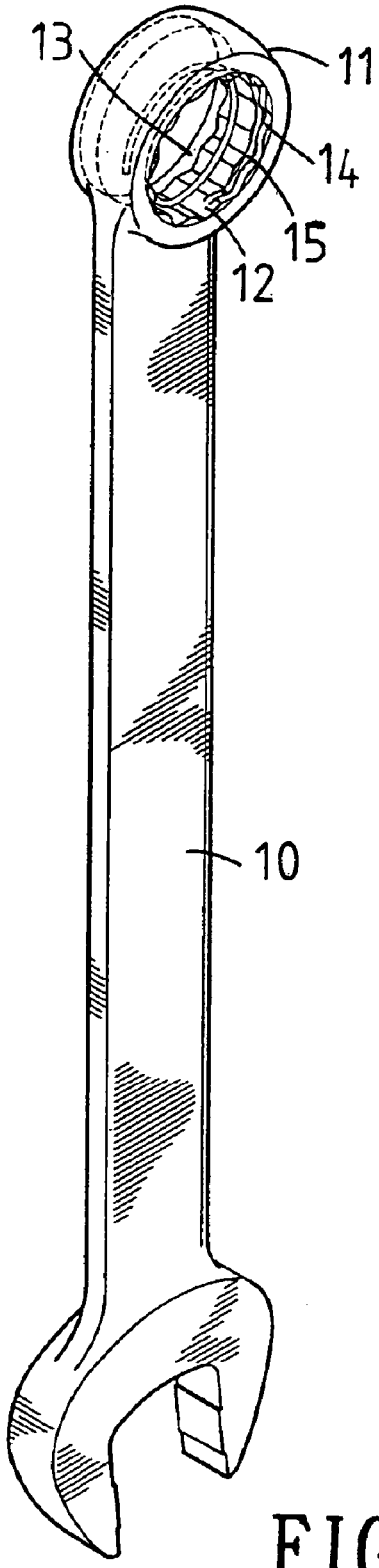
FIG. 3 is a perspective view to show the wrench having the box end of the present invention.
Figure 4:
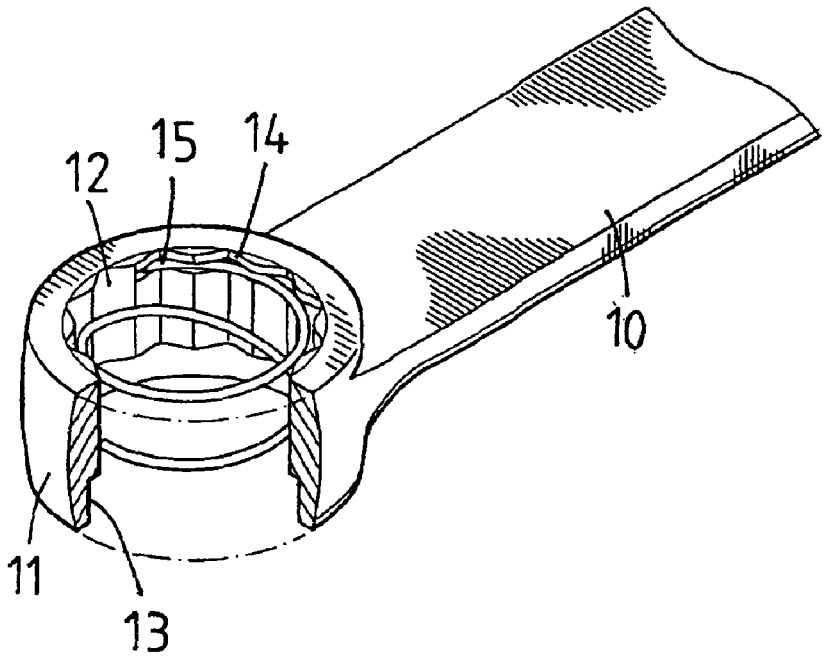
FIG. 4 is a perspective view, the wall of the box end partially removed, of the box end and the spring member in the box end.
Figure 5:
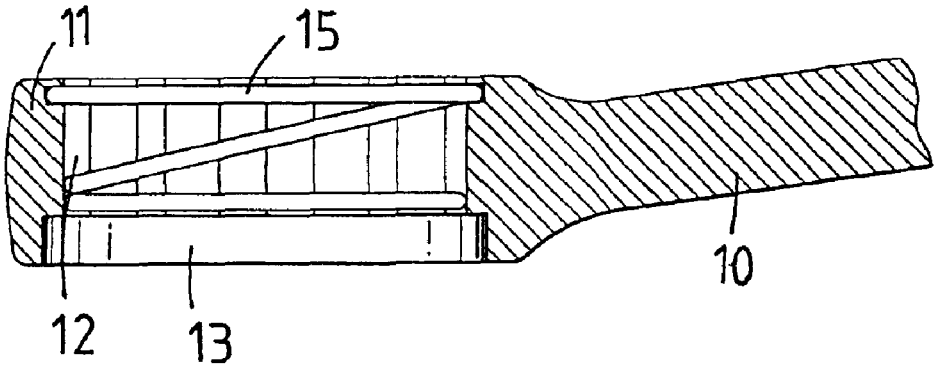
FIG. 5 is a cross sectional view to show the spring member in the box end.
Figure 6:
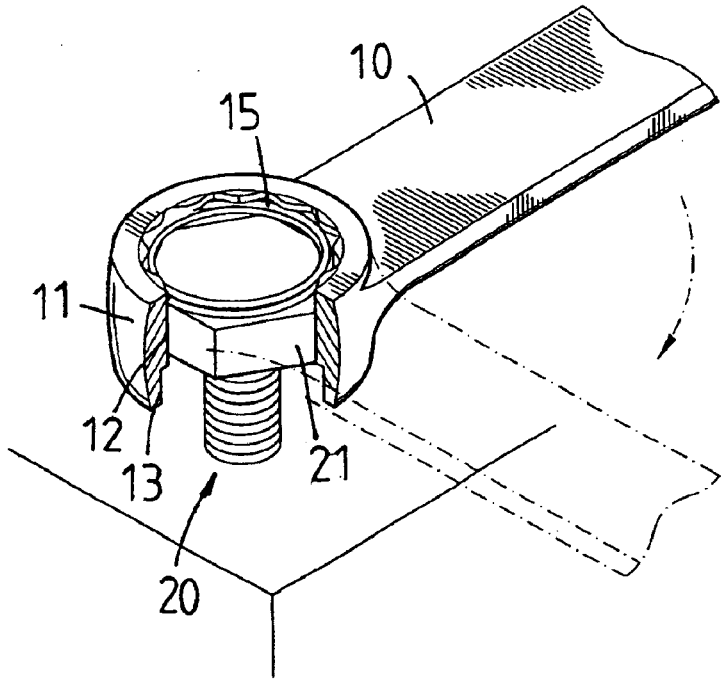
FIG. 6 shows a bolt head is engaged with the polygonal inner periphery of the box end by compressing the spring member.
Figure 7:
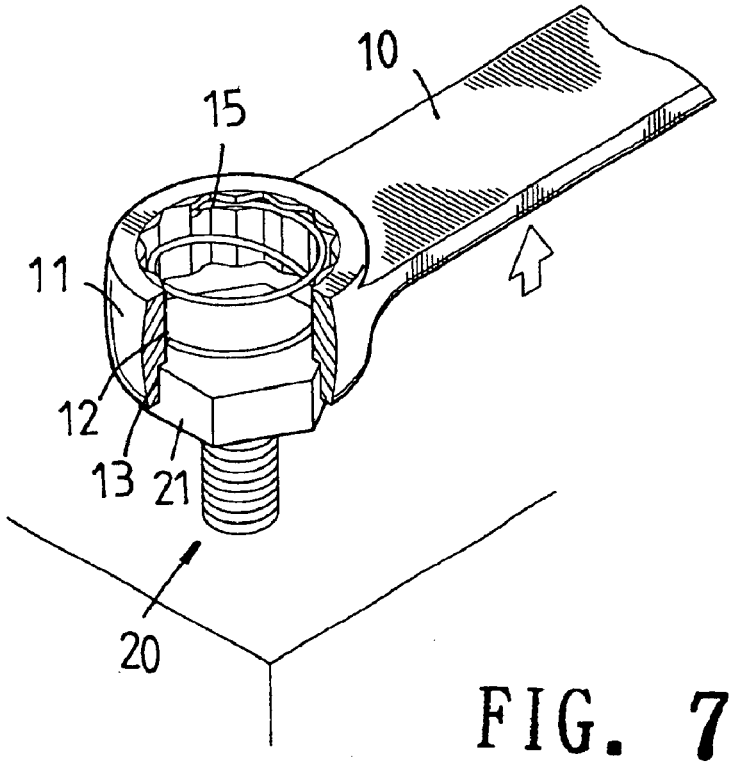
FIG. 7 shows the bolt head is engaged with the plain inner surface of the box end.
Figure 8:
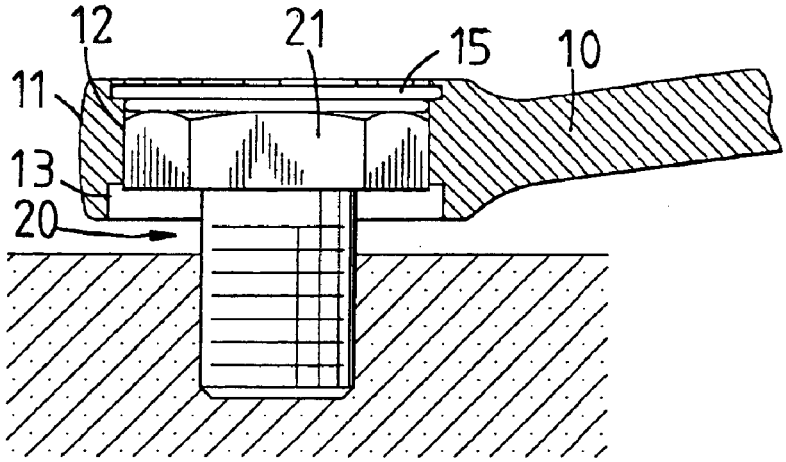
FIG. 8 shows a cross sectional view of the engagement disclosed in FIG. 6.
Figure 9:
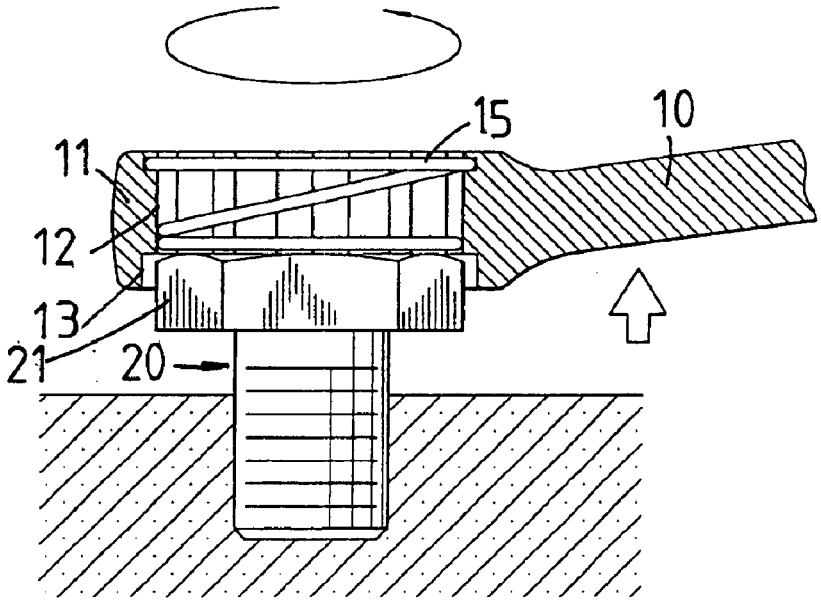
FIG. 9 shows a cross sectional view of the engagement disclosed in FIG. 7.

Referring to FIGS. 1 to 5, the wrench of the present invention comprises a handle 10 and a box end 11 is connected to the handle 10. The box end 11 has a through hole and a first side and a second side. A polygonal inner periphery 12 is defined in an inner periphery of the through hole and located close to the first side of the box end 11. A plain inner surface 13 is defined in the inner periphery of the through hole and located close to the second side of the box end 11. An inner diameter of the plain inner periphery 13 is larger than an inner diameter of the polygonal inner periphery 12. A groove 14 is defined in the polygonal inner periphery 12 and extends less than 360 degrees.

Figure 17:
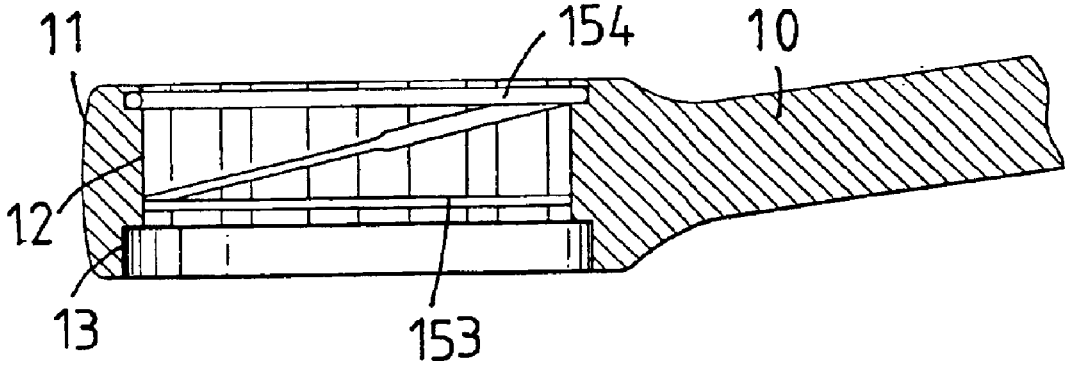
FIG. 17 shows the end of the spring member is a flat end.

A spring member 15 is a coil spring and includes a first end and a second end. The first end of the spring member 15 is engaged with the groove 14 and the spring member 15 is enclosed by the polygonal inner periphery 12. As shown in FIG. 17, the body 153 of the spring member 15 has a flat rectangular cross section and the first end 154 of the spring member 15 has a circular cross section so as to be easily engaged with the groove 14.

Referring to FIGS. 6 to 9, when the box end 11 is mounted to a bolt head 21 of a bolt 20 from the second side of the box end 11, when pressing the box end to let the bolt head 21 compress the spring member 15, the bolt head 21 is engaged with the polygonal inner periphery 12 so that the bolt 20 can be rotated by the wrench. When releasing the pressing force, the spring member 15 pushes the bolt head 21 an the wrench is raised and the bolt head 21 is enclosed by the plain inner surface 13. At this position, because the bolt head 21 is not clamped by the box end 11 so that the box end 11 can be freely rotated regardless of the bolt head 21.

Figure 10:
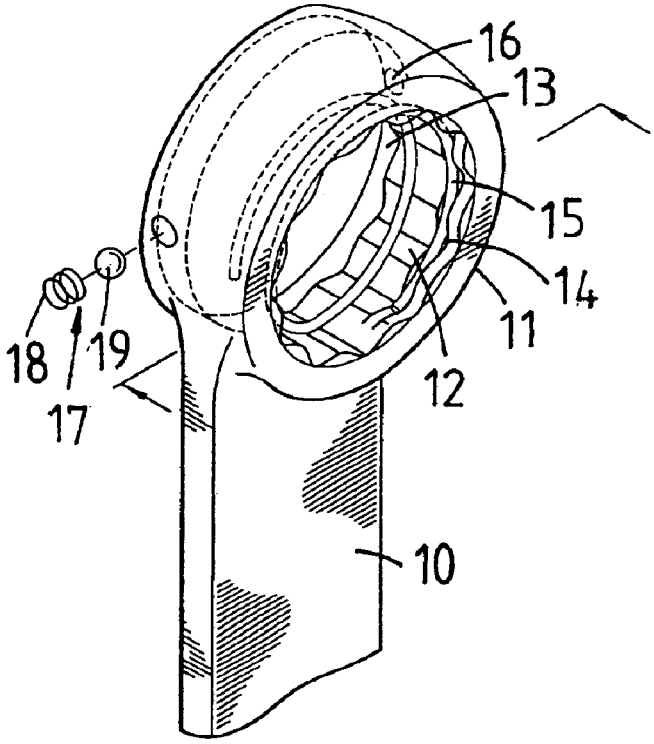
FIG. 10 shows a bead and a spring is engaged with the passage of the bxo end.
Figure 11:
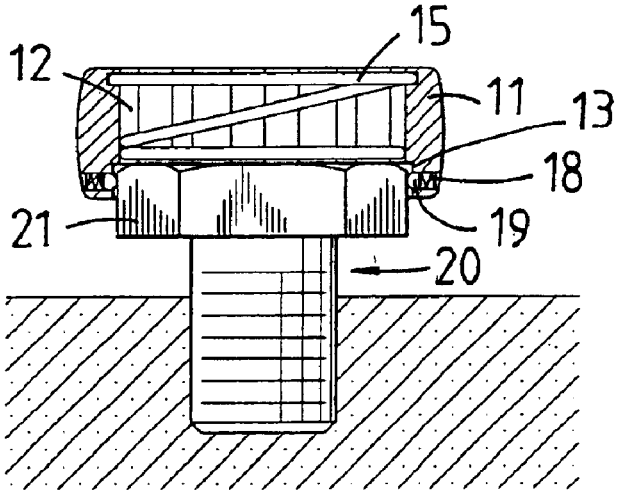
FIG. 11 shows the bead is forced backward into the passage when the bolt head is biased to the second side of the box end.
Figure 12:
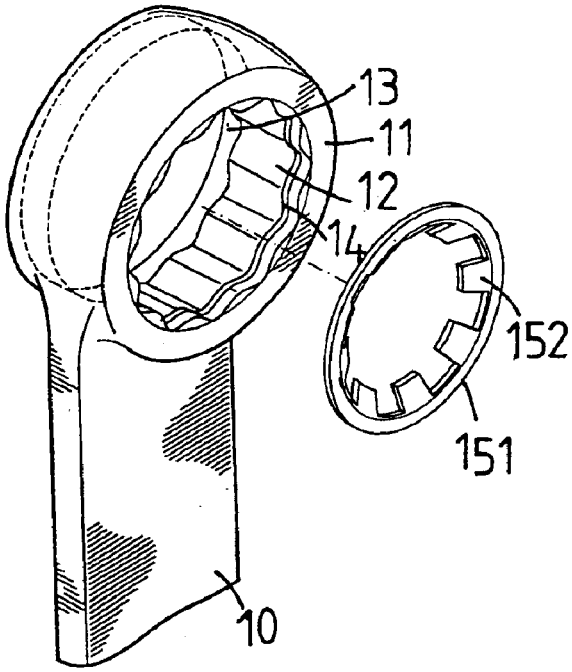
FIG. 12 shows another embodiment of the spring member and the box end of the wrench.
Figure 13:
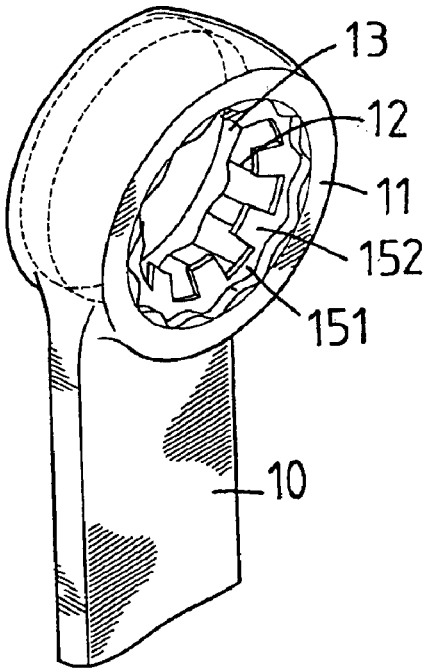
FIG. 13 is a perspective view to show the spring member in FIG. 12 is engaged with the through hole of the box end.
Figure 14:
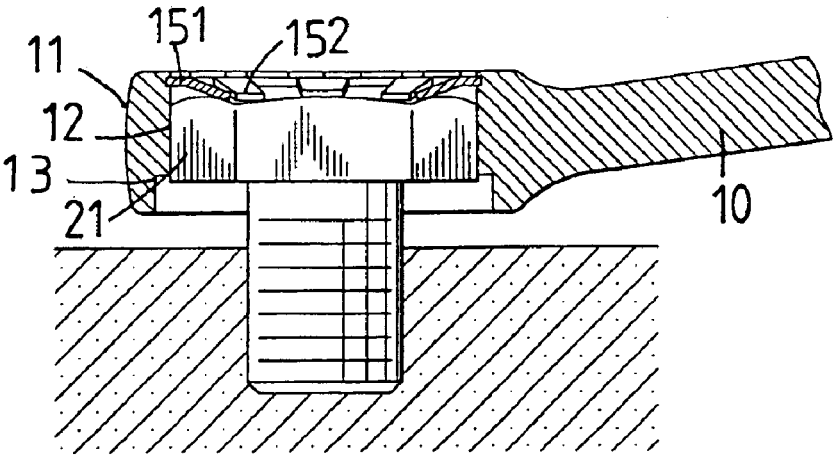
FIG. 14 is a cross sectional view which shows that the bolt head compresses the spring member and is engaged with the polygonal inner periphery of the box end.

Referring to FIGS. 10 and 11, a passage 16 is defined through a wall of the box end 11 and communicates with the through hole. An opening is defined in the plain inner surface 13 by the passage 16. An index assembly 17 including a bead 19 and a spring 18 is received in the passage 16. The bead 19 partially extends into the through hole via the opening, so that when the bolt head 21 is moved to the position in FIG. 11, the user hears a click sound when the bolt head 21 passes through the bead 19.

Figure 15:
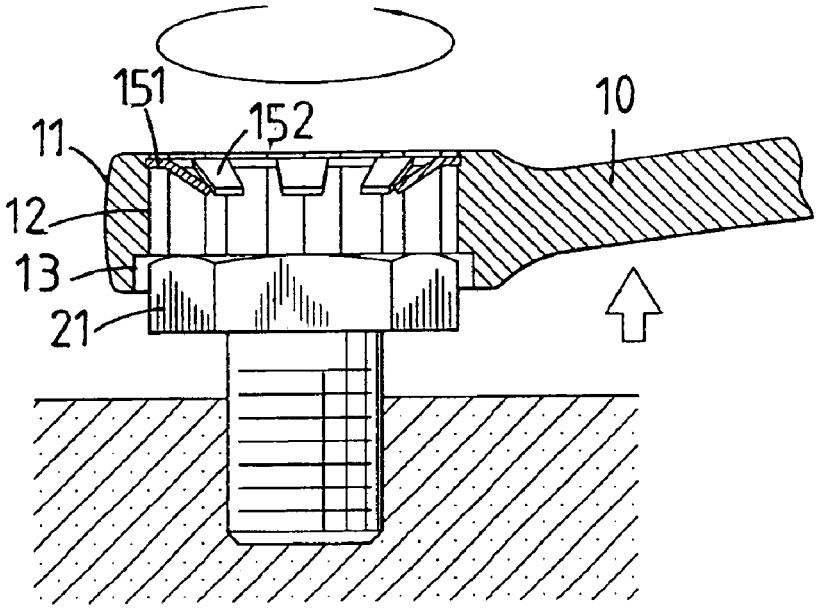
FIG. 15 is a cross sectional view which shows that the bolt head is rotatably enclosed by the plain inner surface of the box end.
Figure 16:
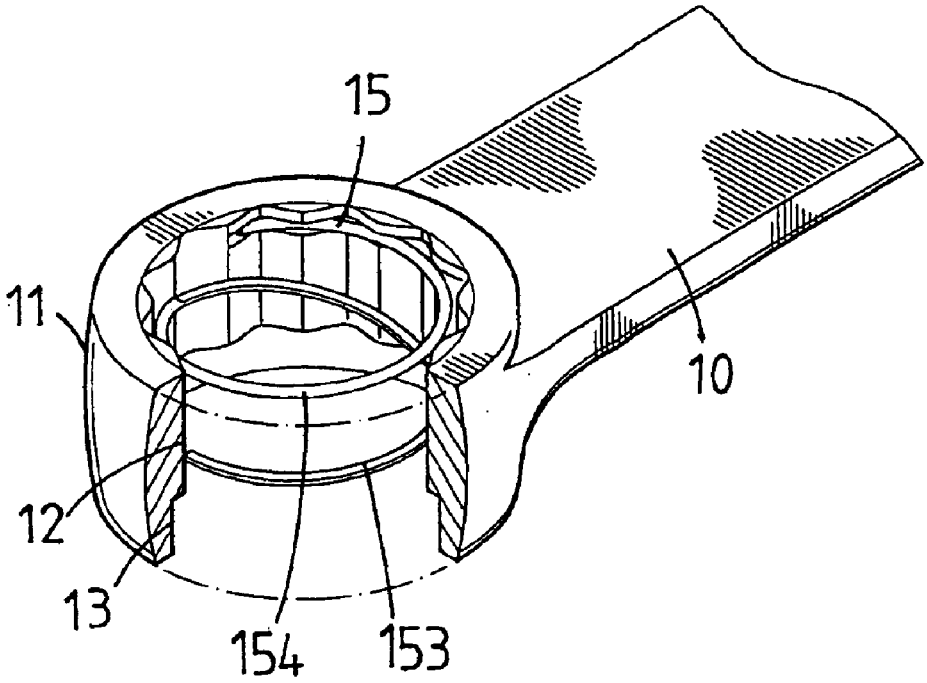
FIG. 16 shows the spring member has a flat rectangular cross section.

Referring to FIGS. 12 to 15, the spring member can be a collar 151 and a plurality of flexible plates 152 extending inclinedly from an inner periphery of the collar 151. An annular groove 14 is defined in the inner periphery of the through hole and the collar 151 is engaged with the groove 14. The bolt head 21 may push the flexible plates 152 and is engaged with the polygonal inner periphery 12 of the box end 11. The flexible plates 152 may push the bolt head 21 as shown in FIG. 15.

While we have shown and described the embodiment in accordance with the present invention, it should be clear to those skilled in the art that further embodiments may be made without departing from the scope of the present invention.

What is claimed is:

1. A wrench comprising:

a handle and a box end connected to the handle, the box end having a through hole and a first side and a second side, a polygonal inner periphery defined in an inner periphery of the through hole and located close to the first side of the box end, a plain inner surface defined in the inner periphery of the through hole and located close to the second side of the box end, an inner diameter of the plain inner periphery being larger than an inner diameter of the polygonal inner periphery, and a spring member engaged with the through hole of the box end and enclosed by the polygonal inner periphery.

2. The wrench as claimed in claim 1, wherein the spring member is a coil spring and includes a first end and a second end, a groove defined in the polygonal inner periphery and extending less than 360 degrees, the first end of the spring member engaged with the groove.

3. The wrench as claimed in claim 1, wherein the first end of the spring member has a circular cross section.

4. The wrench as claimed in claim 1, wherein a body of the spring member including the second end of the spring member has a flat rectangular cross section.

5. The wrench as claimed in claim 1, wherein the spring member is a collar and a plurality of flexible plates extending inclinedly from an inner periphery of the collar, an annular groove defined in the inner periphery of the through hole and the collar engaged with the groove.

6. The wrench as claimed in claim 1, wherein a passage is defined through a wall of the box end and communicates with the through hole, the passage defining an opening in the plain inner surface, an index assembly received in the passage and partially extending into the through hole via the opening.

7. The wrench as claimed in claim 6, wherein the index assembly includes a bead and a spring, the bead partially extending into the through hole via the opening.

* * * * *